US005577434A

United States Patent [19]

Janvrin et al.

[11] Patent Number: 5,577,434

[45] Date of Patent: Nov. 26, 1996

[54] HYDRAULIC VALVE ASSEMBLY

[75] Inventors: Robert B. Janvrin, Easley, S.C.; Jeffrey J. Karabetsos, Kenosha, Wis.; John L. Bocksnick, Beaver Dam, Wis.

[73] Assignee: Danfoss Inc., Rockford, Ill.

[21] Appl. No.: 528,639

[22] Filed: Sep. 14, 1995

[51] Int. Cl.[6] ..... F01L 15/00; F15B 11/00

[52] U.S. Cl. ..... 91/178; 91/536

[58] Field of Search ..... 91/178, 519, 536; 60/484

[56] References Cited

U.S. PATENT DOCUMENTS

| | | | |
|---|---|---|---|
| 2,853,891 | 9/1958 | Tuck | 91/536 X |
| 3,986,434 | 10/1976 | Kohler | 91/178 |
| 4,004,779 | 1/1977 | Flesburg | 91/536 X |
| 4,037,743 | 7/1977 | Pedersen | 91/519 X |
| 4,319,609 | 3/1982 | Debrus | 91/519 X |

*Primary Examiner*—Hoang Nguyen

*Attorney, Agent, or Firm*—Lee, Mann, Smith, McWilliams, Sweeney & Ohlson

[57] ABSTRACT

A hydraulic valve assembly configured for controlling the elevation and operation of a mowing deck of a power mower. The valve assembly includes a housing having a valve spool positionable in four positions, a cylinder activation position, a neutral position, a cylinder relief and motor start position, and a motor run position. In the cylinder activation position pump pressure is connected to a deck raising cylinder. In the neutral position, a status quo is maintained, and pump is vented to tank. In the cylinder relief and motor start position, the mowing deck, if elevated, is lowered under its own weight by relieving pressure on the deck cylinder, and the mowing motor is started in operation under low pressure. In the motor run position, the motor is connected to high pressure, and the deck cylinder continues to be vented to tank.

16 Claims, 5 Drawing Sheets

HYDRAULIC VALVE ASSEMBLY

BACKGROUND OF THE INVENTION

This invention relates to control of hydraulically operated apparatus, and in particular to a hydraulic valve assembly having a positionable valve spool disposed in a housing bore, with the valve spool being movable into four positions, each of which provides a different function in combination with other elements of the valve assembly.

The invention is particularly adapted for operating the deck and mowing motor of a mowing apparatus, although other uses of the valve assembly according to the invention can be envisioned and will be apparent. Given the nature of the invention, it is described in relation to a mowing apparatus.

In a hydraulically-operated mowing apparatus, the mowing deck is raised and lowered as required. Typically the mowing motor is operated only when the deck is lowered and the mowing blades are therefore oriented at a proper elevation for grass cutting. Hydraulic pressure is used for raising the deck as well as operating the mowing motor. There are therefore four basic connections involved, one bringing pump pressure to the mowing apparatus for use, one returning expended hydraulic fluid to a tank reservoir, one to the deck raising and lowering cylinder or cylinders, and one to the motor on the deck for rotating the mowing blades.

SUMMARY OF THE INVENTION

The invention is directed to a hydraulic valve assembly which comprises a valve housing having an elongated axial bore, and having a pump port for connection to pump pressure, a cylinder port for connection to a first hydraulic device such as the deck cylinder, a motor port for connection to a second hydraulic device such as the mowing motor, and a tank port for connection to a tank reservoir. An elongated valve spool is slidably located in the axially bore and is positionable in four positions. Those positions comprise a cylinder activation position, a neutral position, a cylinder relief and motor start position and a motor run position. The valve spool includes means in the cylinder activation position for connecting the pump port to the cylinder port. The valve spool further includes means in the neutral position for connecting the pump port to the tank port and for preventing connection to the cylinder port and to the motor port. The valve spool also includes means in the cylinder relief and motor start position for connecting the cylinder port to the tank port and for connecting the pump port to the motor port with low pressure relief. Finally, the valve spool includes means in the motor run position for connecting the cylinder port to the tank port and for connecting the pump port to the motor port with high pressure relief.

In accordance with the preferred form of the invention, the means in the cylinder activation position comprises an axial bore in the valve spool and a pair of spaced radial bores communicating with the axial bore. When the valve spool is in the cylinder activation position, one of the radial bores is connected to the pump port and the other of the radial bores is connected to the cylinder port so that pump pressure is communicated to the deck raising cylinder.

The means in the neutral position comprises at least one annular groove in the valve spool which bridges spaced pump and tank grooves in the valve housing. First and second fluid seals are located on the valve spool, with one of the fluid seals blocking communication between the pump groove and the cylinder groove, and the other of the fluid seals blocking communication between the pump groove and the motor groove.

Also in the preferred form, the means in the cylinder relief and motor start position includes the axial bore in the valve spool and a pair of spaced radial bores communicating with the axial bore. In the cylinder relief and motor start position, one of the radial bores is connected to the cylinder port and the other of the radial bores is connected to the tank port to relieve pressure on the cylinder. Also, an annular groove is provided in the valve spool bridging the pump groove and a motor groove in the housing in order to direct pump pressure to the motor. In this orientation, a low pressure relief valve is connected to the pump port so that only a relatively low pressure is supplied from the pump to the motor.

The means in the motor run position includes the axial bore in the valve spool and spaced radial bores communicating with the axial bore. In the motor run position, one of the radial bores is connected to the tank port and the other of the radial bores is connected to the cylinder port, so that pressure on the cylinder is relieved. Also, an annular groove is provided in the spool bridging the pump and motor grooves with a high pressure relief valve connected to the pump port in this orientation. Therefore, a relatively higher pressure is supplied to the motor to operate the motor under full power.

Means is provided for maintaining the valve spool at selected ones of the four spool positions. The means for maintaining comprises an extension extending from one end of the valve spool and having means for biassing the valve spool in the neutral position. That means for biassing comprises a double acting spring engaging the extension and the valve spool.

Means is also provided for effecting weight transfer. The means for effecting weight transfer comprises a second valve spool located in a second bore in the housing, and includes means biassing the second valve spool in communication with the tank port. Means is provided to temporarily shift the second valve spool to communicate with the pump port, the means for temporarily shifting comprising a further input spool.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
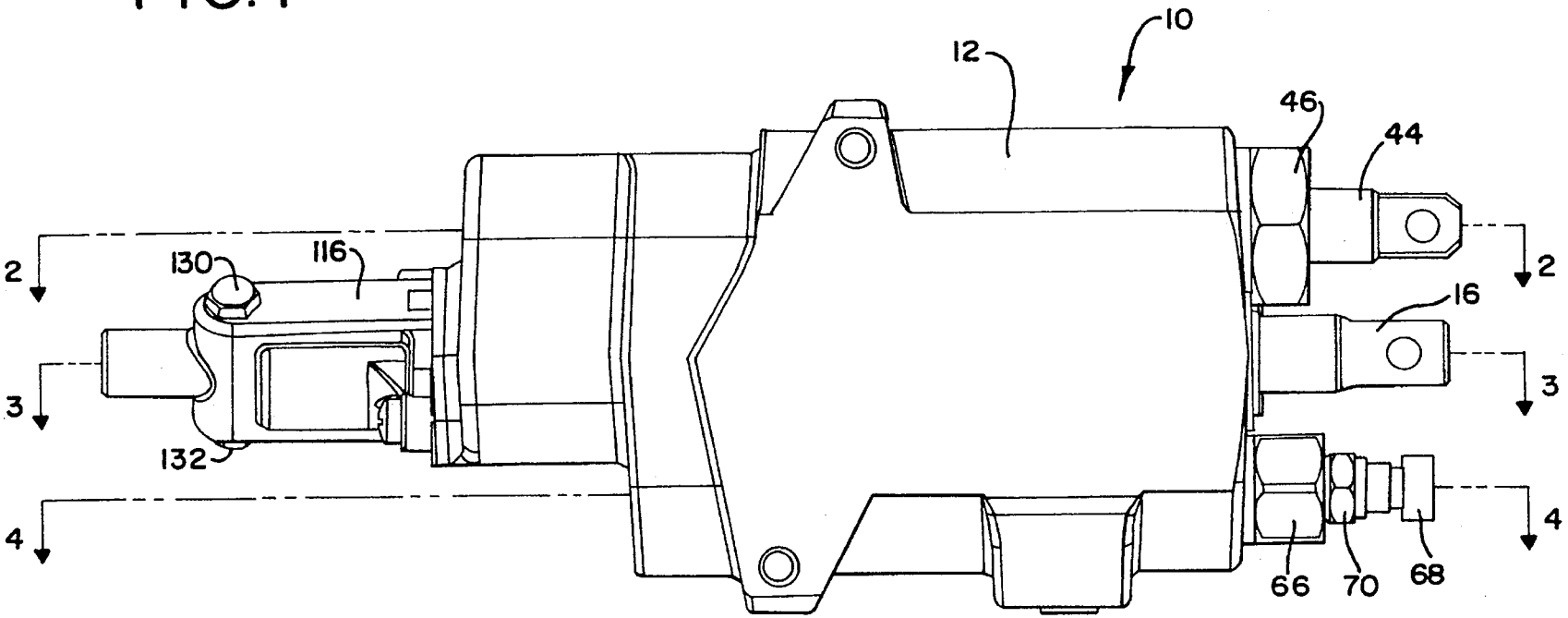
FIG. 1 is an elevational view of the exterior of one form of a hydraulic valve assembly according to the invention.

A hydraulic valve assembly for operating the mowing deck of a mower or for other similar operations is shown generally at 10 in FIG. 1. A circuit diagram for the hydraulic valve assembly 10 is depicted in FIG. 6, and where elements of the hydraulic valve assembly 10 depicted in FIGS. 1 through 5 are schematically illustrated in FIG. 6, the schematically-illustrated elements bear the same reference numerals as the actual elements depicted in the earlier drawing figures.

The hydraulic valve assembly 10 includes a housing 12 having a central, elongated axial bore 14. An elongated valve spool 16 is slidably located within the axial bore 14. The housing 12 and the valve spool 16 include various connecting bores, grooves and channels for effecting the operation described below. Most of the interconnecting portions of the valve assembly 10 are illustrated in FIGS. 1 through 5, and all are schematically illustrated in FIG. 6.

The housing 12 has a pump port 18 for communication with and connection to a hydraulic pump 20. The housing 12 also has a tank port 22 for communication with and connection to a tank reservoir 24. The housing 12 is also provided with a cylinder port 26 for communication with and connection to a deck lifting cylinder 28 of the deck 30 of a hydraulically-operated mowing apparatus (not further illustrated). Finally, the housing 12 includes a motor port 32 for communication with and connection to a motor 34 on the deck 30 for rotation of the cutting blade or blades of the deck 30. The cylinder 28, deck 30, motor 34, pump 20 and tank 24 may be conventional, form no part of the invention, and are therefore not described in greater detail.

The housing 12 also includes a weight transfer assembly 36. The weight transfer assembly 36 has a valve spool 38 biased by a spring 40 on one side and a second spring 42 on the other. The weight transfer assembly 36 also includes an input spool 44 extending through a plug 46 installed in the housing 12 and including a further spring 48. The weight transfer assembly 36 is positioned for connection to either pump pressure from the pump 20 or to the tank reservoir 24, and is normally biased, as shown in FIG. 6, to be connected to the tank reservoir.

The housing 12 also includes an adjustable low pressure relief assembly 50 and an adjustable high pressure relief assembly 52. The high pressure relief assembly 52 is immediately adjacent a main stage relief assembly 54. The elements 50, 52 and 54 may be conventional units used for the various purposes described below.

The low pressure relief assembly 50 extends through a plug 56 installed in the housing 12. An adjustment screw 58 is installed in the plug 56, and is held in place by a nut 60. The screw 58 bears against a spring 62 which biases a valve 64 within a bore in the housing 12.

Similarly, the high pressure relief assembly 52 extends from a plug 66 installed in the housing 12. The relief assembly 52 includes an adjustment screw 68 locked in place by a nut 70. The adjustment screw 68 adjusts the tension of a compression spring 72 which bears against a valve 74.

The main stage relief assembly 54 includes a valve 76 biased by a spring 78. As best shown in FIG. 6, due to the provision of the various springs 62, 72 and 78, the respective valves 64, 74 and 76 are normally biased so that there is no flow through the respective valves unless hydraulic pressure is applied thereto to displace their respective valve spools.

The valve spool 16 includes an axial bore 80 at one end. A series of four different radial bores 82, 84, 86 and 88 extend from and in communication with the axial bore 80. The uses of the bores 80 through 88 will become apparent and are described in greater detail below.

The valve spool 16 also includes a series of annular grooves 90, 92, 94 and 96, between which are located fluid seal portions 98, 100 and 102. Actually, all portions of the valve spool 16 that do not have bores or grooves formed therein are preferably configured to form seals with the bore 14.

The housing 12 has a cylinder bore 104 in communication with the cylinder port 26. It also includes a pump bore 106 in communication with the pump port 18. Tank bores 108 and 110 are provided in communication with the tank port 22. Finally, a motor bore 112 is provided in communication with the motor port 32.

Figure 3:
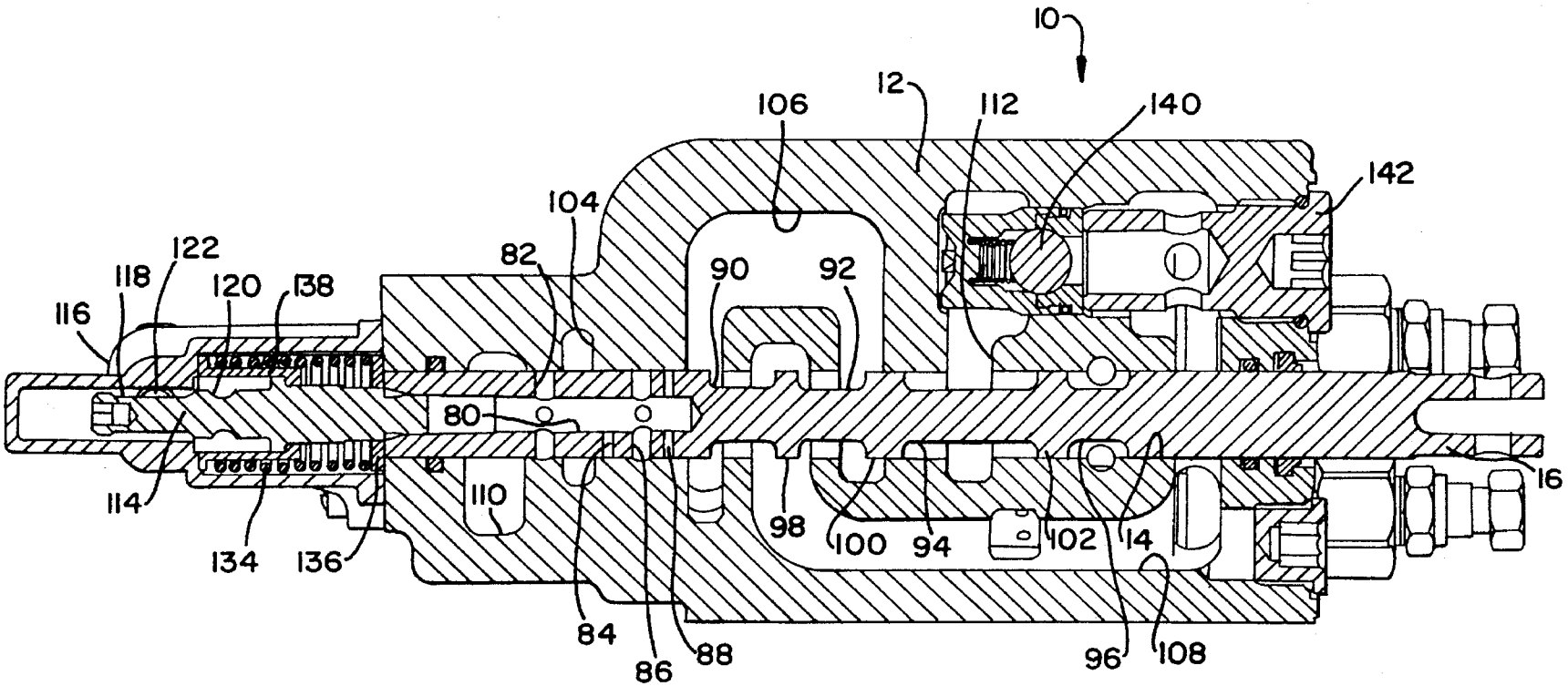
FIG. 3 is a cross-sectional view taken along lines 3—3 of FIG. 1.
Figure 4:
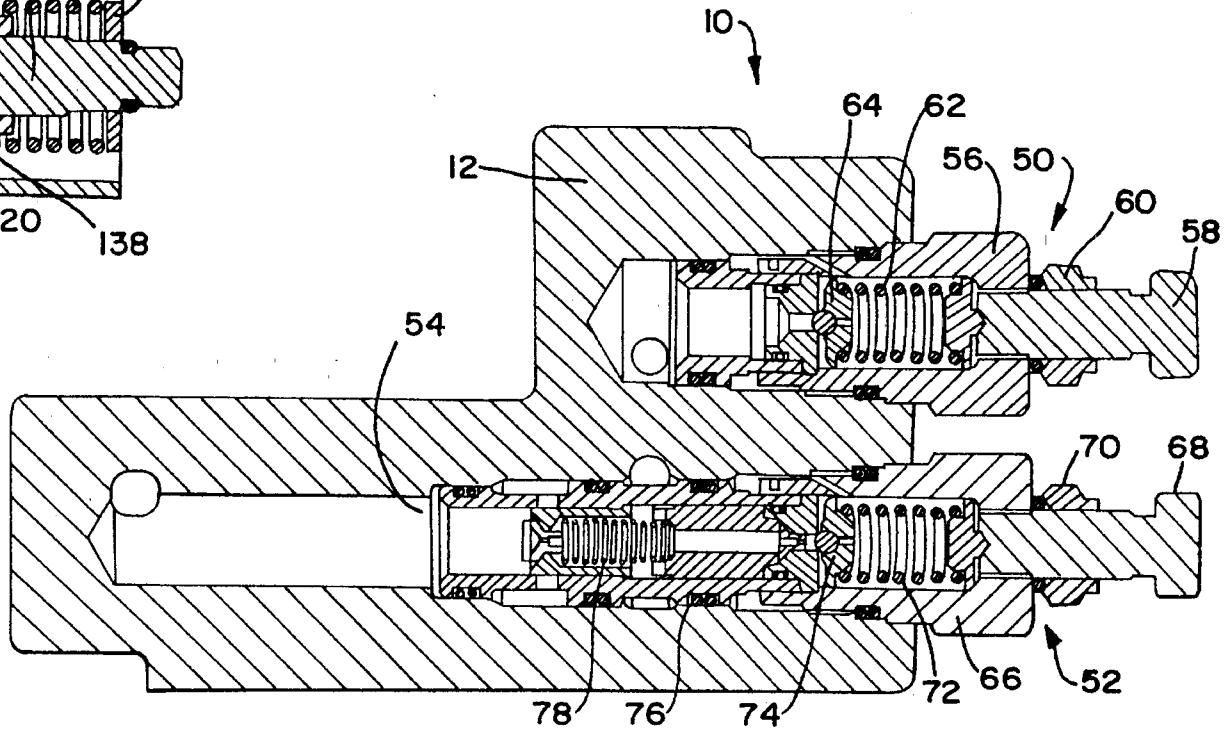
FIG. 4 is a cross-sectional view taken along lines 4—4 of FIG. 1.
Figure 5:
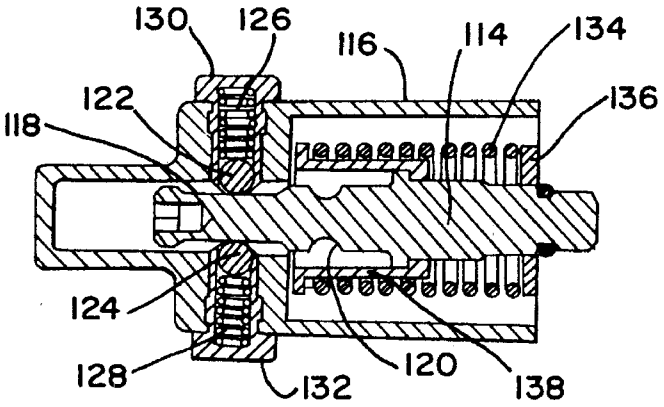
FIG. 5 is a cross-sectional view taken through the left end of the hydraulic valve assembly in relation to FIG. 3, but cross-sectioned through that end at a different angular orientation than shown in FIG. 3.
Figure 6:
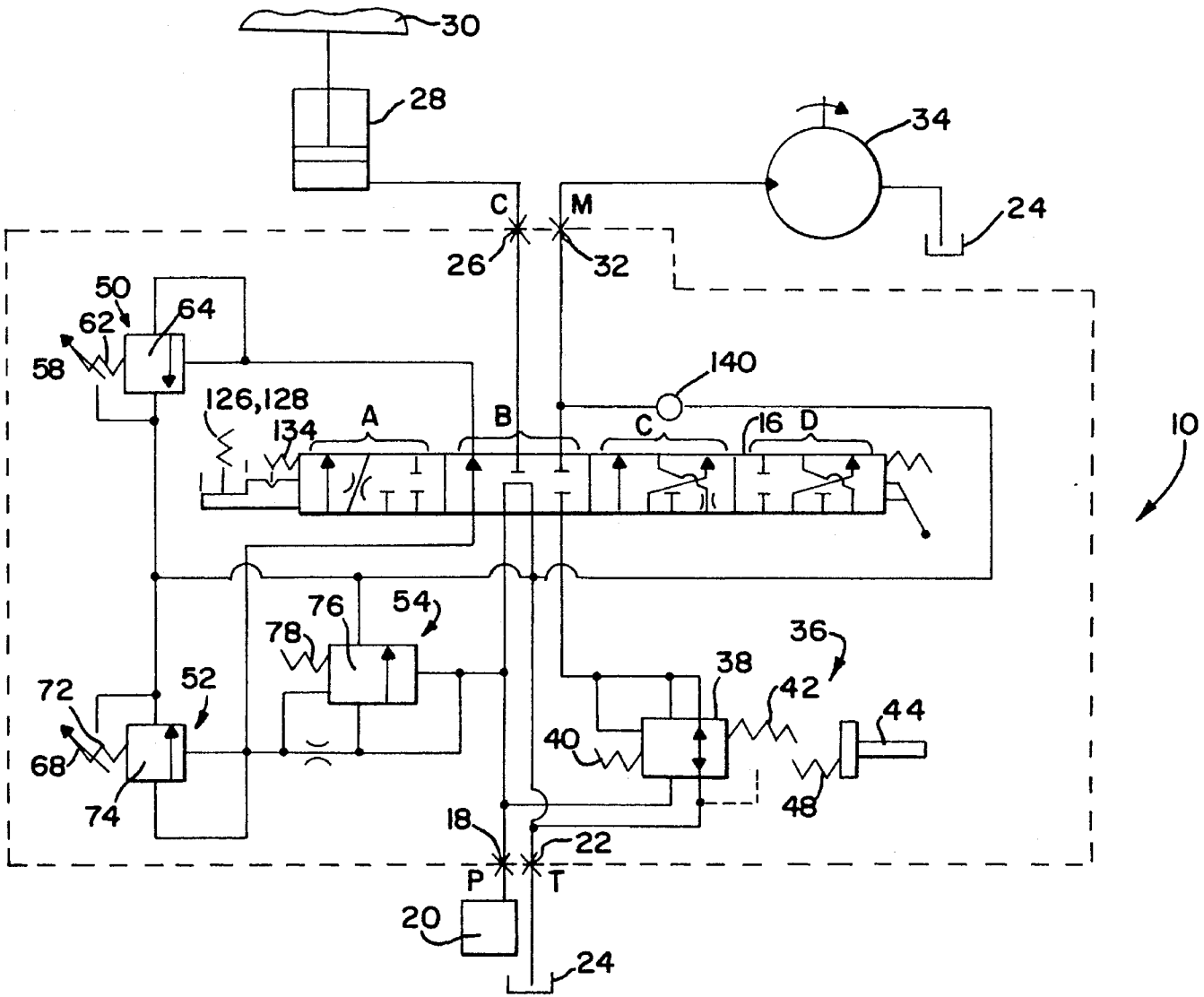
FIG. 6 is a schematic circuit diagram representation of the valve assembly according to the invention including depicted connections to the deck raising cylinder and mowing motor of a typical hydraulically-activated mowing apparatus.

The bore 80 in the spool 16 is sealed by an extension 114 which, as illustrated in FIGS. 3 and 5, is installed within a housing 116 extending from the housing 12. The extension 114 serves as a centering and positioning locator for the valve spool 16. The extension 114 includes a wide annular groove 118 and a narrow annular groove 120. Both grooves 118 and 120 are engageable by spring-biased detent balls 122 and 124, biased by respective springs 126 and 128 held in place by respective caps 130 and 132. Since, as illustrated, a larger diameter portion of the extension 114 is located between the grooves 118 and 120, when the detent balls are located in the groove 120, the extension 114 tends to be held in that position until relocated against the force of the retaining springs 126 and 128. That, of course, also retains the valve spool 16 in place, as well.

The extension 114, and therefore the valve spool 16, is centered by means of a compression spring 134 acting between a washer 136 and an annular shoulder of a cap 138 engaged on the extension 114. As can be seen, the spring 134, bearing between the shoulder of the cap 138 and the washer 136, tends to maintain the extension 114, and therefore the valve spool 16, in the orientation illustrated in the drawings. This, as explained below, is known as the neutral or hold position. No matter which way the spool 16 is displaced, the spring 134 will tend to return the spool 16 to the orientation illustrated, unless the detent balls 122 and 124 are seated in the groove 120. In that instance, the valve spool 16 remains displaced until physically moved against the holding force of the springs 126 and 128.

An anticavitation check assembly 140 is also provided as illustrated. The assembly 140 will, as will be apparent to one skilled in the art, provide flow of hydraulic fluid through the motor port 32 to the motor 34 in appropriate instances. The anticavitation assembly 140 is held in place by a cap 142 installed in a bore in the housing 12.

Turning now to the circuit diagram shown in FIG. 6, the four positions of the valve spool 16 of the valve assembly 10 are explained in relation to the overall function of the valve assembly. For ease of explanation, the positions are illustrated with the letters A, B, C and D. It will be evident to one skilled in the art that movement of the valve spool 16 to the various positions is not nearly as exaggerated as would be expected from the schematic circuit diagram of FIG. 6, since relatively small displacements of the spool 16 in FIG. 3 will result in the differing functions described.

In the neutral position, which is position B, the spool 16 is in the orientation illustrated in the drawing figures, and also in the schematic diagram of FIG. 6. In this orientation, there is a direct connection between pump pressure from the pump 20 and the tank reservoir 24. Thus, pressure is relieved, and there is insufficient pump pressure to activate the low pressure relief assembly 50, the high pressure relief assembly 52 or the main stage relief assembly 54. Also, as illustrated, there is no pressure connection to either the cylinder port 26 or the motor port 32, and further these ports are blocked to therefore place the mower in a neutral or hold position. The cylinder 28 cannot raise or lower the deck 30, and the motor 34, being provided with no pump pressure, is idle.

When the valve spool shown in FIG. 3 is shifted to the right, however, the connections in position A (FIG. 6) occur. In this orientation, pump pressure, albeit constrained, is applied to the lifting cylinder 28 through the cylinder port 26. Also, the high pressure relief assembly 52 and the low pressure relief assembly 50 are interconnected, and the main stage relief assembly 54 is controlled by the pressure relief assemblies 50 and 52. The relief assembly 54 is held closed by the spring 78 and pilot pressure which is also directed to the relief assemblies 50 and 52. Thus, the pressure relief assembly 50, being a lower pressure relief assembly, governs, and any pressure over the setting of the pressure relief assembly 50 causes pump flow through the main stage relief assembly 54. Pump flow is therefore bypassed through the relief assembly 54 to tank through the tank port 22, thus keeping the pressure on the cylinder 28 at that set by the low pressure relief 50. In this orientation, the relatively small radial bore 88 (FIG. 3) is in communication with the pump bore 106, providing pressure to the axial bore 80. The radial bore 82 is aligned in the cylinder bore 104, providing the connection to the cylinder port 26 and therefore to the cylinder 28 to raise the deck 30. The size of the bore 88 reduces flow rate to the cylinder 28. As will be seen, the fluid seal 98 is shifted sufficiently in this orientation that communication between the pump bore 106 and the tank bore 108 is prevented. As explained above, the valve spool 16 must be held in this position against the centering force of the spring 134, and if not, the spool 16 returns to the neutral position shown in FIGS. 3 and 6.

When the spool 16 is shifted to the operative position C shown in FIG. 6, there remains a connection between the low pressure relief assembly 50 and the high pressure relief assembly 52. Therefore, the relief level of the low pressure relief assembly 50 governs, and maintains pump pressure no greater than that of the setting of the relief assembly 50. Greater pressure is vented to tank through the tank port 22.

Also in this orientation, the cylinder port 26 is connected to tank through the valve spool 38, which is maintained in the orientation illustrated in FIG. 6 to provide relief to tank. Also, as illustrated, pump pressure from the pump port 18 is directed to the motor port 32 to start the motor 34. However, since the pressure relief of the low pressure relief assembly 50 governs, the output velocity of the motor 34 is governed by the lower pressure which is provided. Thus, in this orientation, the weight of the deck 30 can compress the cylinder 28 to lower the deck 30, while at the same time the motor 34 begins operation at slow speed and reduced torque (therefore a "soft start").

Turning to FIG. 3, when the spool 16 is in the position C, the relatively small radial bore 84 is communication with the cylinder bore 104, while the radial bore 82 is communication with the tank bore 110. Thus, there is relief to tank of the pressure in the cylinder 28, but due to the size of the bore 84, the flow rate to tank is controlled and the deck 30 is lowered gradually. Also in this orientation, the fluid seals 98 and 100 prevent direct connection between the pump bore 106 and the tank bore 108. However, the pump bore 106 is connected to the motor bore 112, providing pump pressure to the motor 34, that pressure being governed by the setting of the low pressure relief assembly 50.

When the valve spool 16 is shifted further to the left (in relation to FIG. 3), so that the detent balls 122 and 124 engage the groove 120, the valve assembly 10 is in the motor run position, and the connections shown in position D (FIG. 6) occur. In this orientation, there is no connection through the valve spool 16 between the low pressure assembly 50 and the high pressure relief assembly 52. Therefore, the low pressure relief assembly 50 is effectively removed from the circuit, and pressure relief of the pump 20 is governed by the setting of the high pressure relief assembly 52. Also in this orientation, the cylinder port 26 is vented to the tank port 22 through the valve spool 38 of the weight transfer assembly 36, and therefore the deck 30 is allowed to float. At the same time, full pump pressure of the pump 20 is applied to the motor port 32, thus operating the motor 34 at full pressure and therefore full velocity.

Turning to FIG. 3, in the motor run position, the radial bores 86 are in communication with the cylinder bore 104 and the radial bores 82 are in communication with the tank bore 110. Therefore, pressure on the cylinder 28 is fully relieved. Also in this orientation, full pressure is available between the pump 106 and the motor bore 112 through the annular groove 94. Therefore, the motor 34 is operated at maximum pressure, the extent of which is governed by the setting of the high pressure relief assembly 52. So long as the holding force of the springs 126 and 128 against the detent balls 122 and 124, maintaining the balls in the groove 120, overcomes the return force of the spring 134, the valve spool 16 remains in the position D until physically shifted to overcome the holding force of the detent balls 122 and 124. The self centering action of the spring 134 will then tend to return the valve spool 16 to the neutral orientation illustrated in FIGS. 3 and 6.

Figure 2:
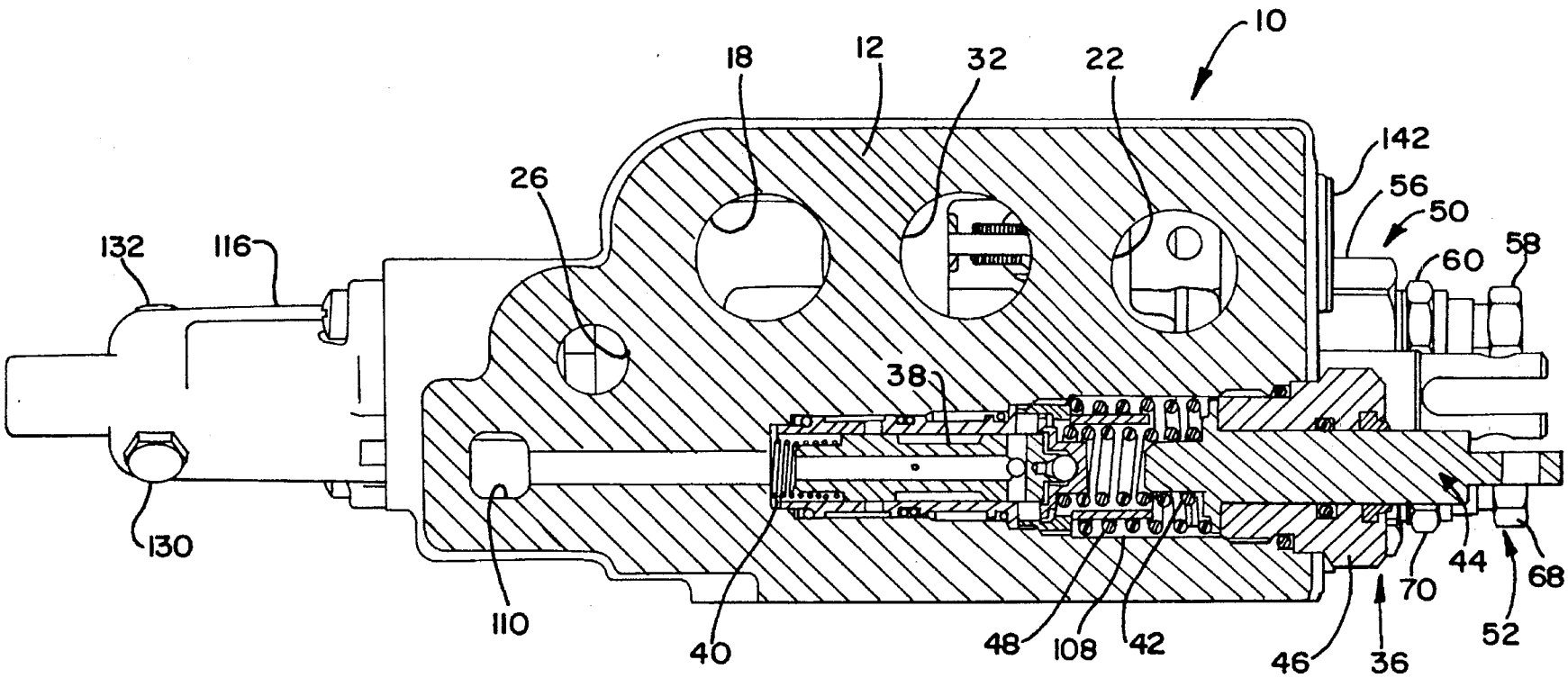
FIG. 2 is a cross-sectional view taken through the valve of FIG. 1 along lines 2—2.

The weight transfer feature of the weight transfer assembly 36 is inoperative unless and until the input spool 44 is depressed (or shifted to the left in relation to FIG. 2). In the normal operating position shown in FIGS. 2 and 6, the spool 38 provides a direct connection through the spool to the tank port 22 and therefore to the tank reservoir 24. However, when the input spool 44 is depressed (shifted to the left), the spool 38, under the influence of the spring 42, is shifted. If pressure is low enough, the spool 38 shifts sufficiently so that there is a connection of pump pressure through the spool 38. When the valve spool 16 is either in the cylinder relief and motor start position (position C) or the motor run position (position D), there therefore is a connection of pump pressure through the spool 38, and then through the spool 16 to the cylinder port 26 and therefore to the cylinder 28. The deck 30 therefore tends to be lifted, shifting weight to the wheels of the mowing apparatus. At the same time, however, pressure is also applied to the spool 38 to return it to the orientation shown in FIGS. 2 and 6. As pressure in the cylinder 28 increases, therefore, the spool 38 shifts back to the normal orientation illustrated to prevent a further pressure increase in the cylinder 28. Thus, a weight transfer will occur in this orientation, the amount of the transfer and its duration being governed by the force of the various springs 40, 42 and 48, as will be apparent to one skilled in the art.

While the invention has been illustrated and described in relation to use of the valve assembly 10 to operate the mowing deck and hydraulic mowing motor of a hydraulically-activated mowing apparatus, it will be apparent that the valve assembly 10 can be used for other appropriate purposes, as well. Various changes can be made to the invention without departing from the spirit thereof or scope of the following claims.

What is claimed is:

1. A hydraulic valve assembly, comprising a. a valve housing having an elongated axial bore, and having a pump port for connection to pump pressure, a cylinder port for connection to a first hydraulic device, a motor port for connection to a second hydraulic device and a tank port for connection to a tank reservoir, b. an elongated valve spool slidable in said axial bore and positionable in four positions comprising,
i. a cylinder activation position,
ii. a neutral position,
iii. a cylinder relief and motor start position, and
iv. a motor run position, c. said valve spool including means in the cylinder activation position for connecting said pump port to said cylinder port, d. said valve spool including means in the neutral position for connecting said pump port to said tank port and for preventing connection to said cylinder port and said motor port, e. said valve spool including means in the cylinder relief and motor start position for connecting said cylinder port to said tank port and connecting said pump port to said motor port with low pressure relief, and f. said valve spool including means in the motor run position for connecting said cylinder port to said tank port and connecting said pump port to said motor port with high pressure relief.

2. A hydraulic valve assembly according to claim 1 in which said means in the cylinder activation position comprises an axial bore in said valve spool and a pair of spaced radial bores communicating therewith, one of said radial bores being connected to said pump port in said cylinder activation position and the other of said radial bores being connected to said cylinder port in said cylinder activation position.

3. A hydraulic valve assembly according to claim 1 in which said means in the neutral position comprises at least one annular groove in said valve spool bridging spaced pump and tank grooves in said housing, and first and second fluid seals in said valve spool, one of said fluid seals blocking communication between said pump groove and a cylinder groove in said housing and the other of said fluid seals blocking communication between said pump groove and a motor groove in said housing.

4. A hydraulic valve assembly according to claim 1 in which said means in the cylinder relief and motor start position comprises an axial bore in the valve spool and a pair of spaced radial bores communicating therewith, one of said radial bores being connected to said cylinder port and the other of said radial bores being connected to said tank port, and an annular groove in said spool bridging spaced pump and motor grooves in said housing.

5. A hydraulic valve assembly according to claim 4 including a low pressure relief valve connected to said pump port when said spool is in said cylinder relief and motor start position.

6. A hydraulic valve assembly according to claim 5 including means for adjusting said low pressure relief valve.

7. A hydraulic valve assembly according to claim 1 in which said means in the motor run position comprises an axial bore in said valve spool and a pair of spaced radial bores communicating therewith, one of said radial bores being connected to said tank port and the other of said radial bores being connected to said cylinder port, and an annular groove in said spool bridging spaced pump and motor grooves in said housing.

8. A hydraulic valve assembly according to claim 7 including a high pressure relief valve connected to said pump port when said spool is in said motor run position.

9. A hydraulic valve assembly according to claim 8 including means for adjusting said high pressure relief valve.

10. A hydraulic valve assembly according to claim 1 including means for maintaining said valve spool at selective ones of said four positions.

11. A hydraulic valve assembly according to claim 10 in which said means for maintaining comprises an extension extending from one end of said valve spool and having means for biasing said valve spool in said neutral position.

12. A hydraulic valve assembly according to claim 11 in which said means for biasing comprises a double acting spring engaging said extension and said valve spool.

13. A hydraulic valve assembly according to claim 1 including means for effecting weight transfer.

14. A hydraulic valve assembly according to claim 13 in which said means for effecting weight transfer comprises a second valve spool located in a second bore, and including means biasing said second valve spool to provide a path in communication with said tank port.

15. A hydraulic valve assembly according to claim 14 including means to temporarily shift said second valve spool to communicate with said pump port.

16. A hydraulic valve assembly according to claim 15 in which said means to temporarily shift comprises an input spool.

* * * * *